US005395555A

United States Patent [19]

Colurciello et al.

[11] Patent Number: 5,395,555

[45] Date of Patent: Mar. 7, 1995

[54] CLEANING COMPOSITION FOR ANIMAL URINE REMOVAL

[75] Inventors: Andrew F. Colurciello, Newburgh; Jeanne M. Weller, Glen Rock, both of N.Y.

[73] Assignee: Eastman Kodak Company, Rochester, N.Y.

[21] Appl. No.: 157,863

[22] Filed: Nov. 22, 1993

[51] Int. Cl.[6] ..... C11D 3/37

[52] U.S. Cl. ..... 252/546; 252/173; 252/174.18; 252/174.23; 252/174.24; 252/550; 252/552; 252/DIG. 11; 252/DIG. 14; 252/DIG. 15

[58] Field of Search ..... 252/174.24, 174.23, 252/DIG. 2, DIG. 19, 88, 173, 174.18, 546, 550, 552, DIG. 11, DIG. 14, DIG. 15

[56] References Cited

U.S. PATENT DOCUMENTS

| | | | |
|---|---|---|---|
| 2,850,460 | 9/1958 | Ginn et al. | 252/153 |
| 3,214,454 | 10/1965 | Blaser et al. | 260/429.9 |
| 3,607,760 | 9/1971 | McIntyre | 252/104 |
| 3,723,358 | 3/1973 | Morgan et al. | 252/546 |
| 3,835,071 | 9/1974 | Allen et al. | 252/545 |
| 3,903,259 | 9/1975 | Hart | 424/76 |
| 3,935,862 | 2/1976 | Kraskin | 128/287 |
| 4,124,542 | 11/1978 | Devine | 252/546 |
| 4,203,859 | 5/1980 | Kirn et al. | 252/174.23 |
| 4,240,918 | 12/1980 | Lagasse et al. | 252/95 |
| 4,273,786 | 6/1981 | Kraskin | 424/319 |
| 4,336,165 | 6/1982 | Weisensel | 252/258 |
| 4,490,270 | 12/1984 | Hackett et al. | 252/106 |
| 4,518,517 | 5/1985 | Eigen et al. | 252/107 |
| 4,556,434 | 12/1985 | Woogerd | 134/22.14 |
| 4,652,339 | 3/1987 | Moll | 252/90 |
| 4,678,595 | 7/1987 | Malik et al. | 252/174.17 |
| 4,686,050 | 8/1987 | Howerin | 252/8.8 |
| 4,810,411 | 3/1989 | Del Pesco et al. | 252/174.23 |
| 4,847,004 | 7/1989 | McLeod | 252/527 |
| 4,902,434 | 2/1990 | Dickerson | 252/8.6 |
| 5,338,475 | 8/1994 | Corey et al. | 252/89.1 |

FOREIGN PATENT DOCUMENTS

| | | | |
|---|---|---|---|
| 42875/89 | 5/1990 | Australia | C11D 3/39 |

*Primary Examiner*—Hoa Van Le
*Attorney, Agent, or Firm*—J. Jeffrey Hawley

[57] ABSTRACT

An aqueous cleaning composition for carpets, rugs, and textiles particularly useful in reducing malodor of urine stains has been discovered with the composition comprising:

(a) from about 4.23% to about 4.28% by weight of a sodium or potassium salt of a diethylenetriaminepentaacetic acid, an ethylenediaminetetraacetic acid, a N-hydroxyethylethylenediaminetriacetic acid, or mixtures thereof;

(b) from about 1.95% to about 2.05% by weight of a diethylenetriaminepentaacetic acid, an ethylenediaminetetraacetic acid, a N-hydroxyethylethylenediaminetriacetic acid, or a mixture thereof;

(c) from about 0.82% to 0.98% of a sodium lauryl sulfate;

(d) from about 0.49% to 0.59% by weight of an acrylate copolymer of the formula $CF_3(CF_2)_nCH_2OCOC(CH_3)=CH_2$ wherein n is from 6 to 8;

(e) from about 0.22% to about 0.27% by weight of an octylphenoxypolyethoxy ethanol;

(f) from about 0.35% to about 0.5% by weight of fragrance; and (g) from about 0.00003% to about 0.05% by weight of a preservative 1,2-benzoisothiazole-3(2H)-ones;

wherein said weight percentages are based on the total active ingredient weight of the aqueous composition.

The composition is effective in removing pet stains and malodors associated therewith from carpeting without imparting undesirable properties on the cleaned surface.

15 Claims, No Drawings

CLEANING COMPOSITION FOR ANIMAL URINE REMOVAL

FIELD OF THE INVENTION

This invention relates to cleaning compositions particularly useful in removing pet urine and odors associated therewith, from rugs, carpets, and textiles.

BACKGROUND OF THE INVENTION

A wide variety of carpet cleaning and anti-soiling compositions are available for do-it-yourself carpet cleaning. One area that remains a challenge is cleaning rugs, carpets and textiles stained with animal urine (particularly from dogs and cats) in conjunction with substantially removing the odors associated with such stains.

In formulating a new carpet cleaning composition, it is particularly challenging to impart a new property into an existing composition without destroying other worthwhile properties of the composition. Typical problems encountered include rapid resoiling of the treated portion of the carpet in addition to leaving the carpet with a "sticky" residue such that the "softness" of the carpet deteriorates after cleaning. Additionally, other undesirable properties include damage to the carpet by spotting, color loss, or leaving an undesirable residue. For the composition itself, efficacy, foaming, stability, and ability to form and stay in solution are each important for a successful commercial product.

There remains a need for alternative cleaning compositions useful in removing animal urine stains and odors (particularly for household pets) from carpets, rugs, and other textiles, without imparting undesirable properties.

SUMMARY OF THE INVENTION

The need discussed above has been satisfied with the discovery of an aqueous cleaning composition comprising:

(a) from about 4.23% to about 4.28% by weight of a sodium or potassium salt of a diethylenetriaminepentaacetic acid, an ethylenediaminetetraacetic acid, a N-hydroxyethylethylenediaminetriacetic acid, or mixtures thereof;

(b) from about 1.95% to about 2.05% by weight of a diethylenetriaminepentaacetic acid, an ethylenediaminetetraacetic acid, a N-hydroxyethylethylenediaminetriacetic acid, or a mixture thereof;

(c) from about 0.82% to 0.98% of a sodium lauryl sulfate;

(d) from about 0.49% to 0.59% by weight of an acrylate copolymer of the formula $CF_3(CF_2)_nCH_2OCOC(CH_3){=}CH_2$ wherein n is from 6 to 8;

(e) from about 0.22% to about 0.27% by weight of an octylphenoxypolyethoxy ethanol;

(f) from about 0.35% to about 0.5% by weight of fragrance; and (g) from about 0.00003% to about 0.05% by weight of a preservative selected from the group consisting of 5-chloro-2-methyl-4-isothiazolin-3-one, 2-methyl-4-isothiazolin-3-one, and mixtures thereof. All weight percentages reflect active ingredient amounts based on the total weight of the aqueous composition.

The composition is particularly effective in removing animal urine stains as well as the malodor associated with these types of stains.

Further, the efficacy in removing the stains is achieved without contributing to undesirable properties commonly associated with carpet cleaning compositions as discussed in more detail hereinafter. Additionally, the composition exhibits low foaming, good stability as well as the ability to form and stay in solution.

DETAILED DESCRIPTION OF THIS INVENTION

The potassium or sodium salt as described in (a) above is most preferably sodium ethylenediaminetetraacetic acid. This is a readily available chelating agent commercially available as HAMPENE TM 100LS (Grace Chemical), VERSENE TM 100LS (Dow Chemical) and SEQUESTRENE TM 30A (Ciba Geigy). A more preferred amount employed is approximately 4.25 weight %.

Component (b) is more preferably ethylenediaminetetraacetic acid as available from a number of suppliers as, for example, HAMPENE TM Acid (Grace Chemical) and SEQUESTRENE TM AA (Ciba Geigy). Most preferably, the amount employed is approximately 2 weight %.

Component (c) is an anionic surfactant widely commercially available, as, for example, RHODAPON TM LCP (Rhone-Poulenc); STANDAOL TM WA (Henkel); or STEPANOL TM WA (Stepan). Most preferably, the amount used is approximately 0.9 weight %.

Component (d) is an acrylate copolymer of the previously described formula wherein the preparation is generally characterized by a total fluorine content based on polymer solids of approximately 0.6 percent. The polymer also may contain a zinc complex to act as a crosslinker. The Number Average (Mn) and Weight Average (Mw) Molecular Weights are generally in the range of approximately 9,000 and approximately 10,500 respectively. The copolymer may be obtained commercially as a water based dispersion of approximately 76–77 weight % water; 18–19 weight % acrylate copolymer; 1 weight % nonylphenoxypolyethoxyethanol; 1 weight % sodium lauryl sulfate; and 1 weight % zinc oxide complex (with said weight % of the ingredients based on the total weight of the water dispersion), as SYNTRAN TM 1575 (Interpolymer Corporation, Canton, Mass.). When the SYNTRAN TM composition is employed as the acyrlate, preferably the amount ranges from about 2.75 weight % to about 3.25 weight % (0.49 weight % to 0.59 weight % of the acrylate polymer), and more preferably approximately 3 weight % (approximately 0.54 weight % of the acrylate polymer).

Component (e) is widely available commercially, as, for example, TRITON TM X-100 (Union Carbide) or T-DET TM 0–9 (Harcros). This component assists in emulsifying the fragrance oil, and may be used in amounts necessary to accomplish this, with the understanding that heavy resoiling will result if too much is employed. Preferably from about 0.22 weight % to about 0.27 weight % (more preferably approximately 0.25 weight %) is employed. The fragrance composition may be acquired from numerous suppliers including Givaudan Roure. For emulsifying purposes, preferred amounts included in the composition range from about 0.35 weight % to about 0.5 weight %. More preferably approximately 0.4 weight % is employed.

Component (g) is most preferably a mixture of 5-chloro-2-methyl-4-isothiazolin-3-one and 2-methyl-4-isothiazolin-3-one marketed under the tradename KATHON TM CG-ICP preservative from Rohm and Haas) present in an amount of approximately 0.001 to 0.002 by weight of active ingredient (due to cost, although a greater amount is not generally associated with a deleterious effect). The KATHON TM CG-ICP is characterized as a combination of 5-chloro-2-methyl-4-isothiazolin-3-one (1–1.20 weight %) and 2-methyl-4-isothiazolin-3-one (0.25–0.45 weight %); magnesium chloride and nitrate (1.4–2.0 weight %); cupric nitrate (0.15–0.17 weight %); and water (95.5–96.2). When employing KATHON TM CG-ICP, preferably the amount employed is from about 0.04 weight % to about 2 weight % (without requiring the use of an additional preservative such as formaldehyde). More preferably about 0.1 weight % of KATHON TM CG-ICP is used.

The compositions of the invention may include optional ingredients for performing specifically desired functions such as sequestrates, e.g., citric acid, sodium hexametaphosphate, and the like; organic liquid solvents, e.g., monohydric aliphatic alcohols having 1 to 6 carbon atoms; corrosion inhibitors, such as, citric acid, sodium citrate, sodium nitrate, ammonia, and so on; as well as additional preservatives, such as methyl- and ethylparaben or formaldehyde (formalin).

The compositions of the invention are preferably formulated as aqueous solutions or emulsions and can be dispensed for use as liquids using conventional dispensing devices such as squeeze bottles fitted with a suitable dispensing nozzle or containers fitted with trigger spray pumps which are well known in the art.

The pH of the aqueous compositions of the invention preferably falls within a range of from about 4 to about 9.5, more preferably from 5 to 8, and most preferably between 6 and 7. If the composition requires an pH adjustment to fall within this range, known pH adjusting agents may be employed.

The composition may be prepared using conventional techniques known to those skilled in the art. The composition is a substantially clear liquid having the viscosity similar to that of water and may be stored as a stable liquid for extended periods.

Preferably, carpets are cleaned by applying the composition directly on the carpet, by spraying, for example, followed by rubbing the sprayed area with a suitable device, such as, for example, a clean damp cloth or sponge mop, with rinsing until the stain or soil is removed. Textiles may also be cleaned by the composition in a similar manner. A more preferred method of use of the cleaning composition generally involves: applying the composition to the carpet (or rug) until saturated, allowing the composition to stand for approximately 10 minutes, blotting the stained area with a cloth, finished by rubbing inwards toward the stain. For extra tough stains and odors, repeat applications are recommended.

The composition of the invention is illustrated by the following examples of specific formulations without, however, being limited thereto.

EXAMPLES

Formula A was prepared by techniques familiar to those skilled in the art using ingredients as shown in the Tables. Formulas A was tested for stability for 6 weeks at room temperature, 105° F., 120° F. and 40° F. Additionally, the formula was subjected to a freeze-thaw test for 3 cycles (thaw for 24 hours after freezing). All tests results for the formula showed the formula as stable.

FORMULA A

| Ingredient | Weight Percentage |
|---|---|
| $Na_4EDTA$[a] (38%) | 11.2 |
| EDTA Acid[b] | 2 |
| Acrylic Copolymer[c] (18%) | 3 |
| Octylphenoxypolyethoxy ethanol[d] | 0.25 |
| Sodium lauryl sulfate[e] (30%) | 3 |
| Fragrance[f] | 0.4 |
| Preservative[g] | 0.1 |
| Water | q.s. |
| pH = ≈6.6 | |

[a]Sodium ethylenediaminetetraacetic acid purchased as HAMPENE TM 100LS (Grace Chemical). (Active ingredient amount: 4.25 weight %).
[b]Ethylenediaminetetraacetic acid purchased as HAMPENE TM Acid (Grace Chemical).
[c]SYNTRAN TM 1575 (Interpolymer Corp., Canton, Mass.) as described previously herein. (Active ingredient amount of acrylic copolymer: 0.54 weight %).
[d]TRITON TM X-100 (Union Carbide).
[e]RHODAPON TM LCP (Rhone-Poulenc). (Active ingredient: 0.9 weight %).
[f]Fragrance TAZ22119 purchased from Givaudan Roure).
[g]KATHON TM CG-ICP (Rohm and Haas) as described previously herein. (Active ingredient: 0.00156 weight %).

TABLE A

| Test Carpets |
|---|
| DuPont STAINMASTER TM CHAMPLIN Almond |
| DuPont STAINMASTER CHAMPLIN Ocean Blue |
| DuPont STAINMASTER CHAMPLIN Embers |
| DuPont STAINMASTER CHAMPLIN Golf Green |
| Philadelphia MAINSTREET TM Cottonseed |
| Philadelphia MAINSTREET Imperial Red |
| Philadelphia MAINSTREET Smoked Blue |
| Philadelphia MAINSTREET Laguna Green |
| Etoil Wool Geranium |
| Etoil Wool Elegan |
| Lees Polyester Parchment |
| Lees Polyester Bordeaux |
| Lees Polyester Sapphire |

Example 1

The effect of Formula A on the color and overall appearance of each of the carpets listed in Table A was conducted.

Samples of the carpets were cut in 12"×12" pieces. For the control, each sample of carpet was sprayed with 25 g of distilled water and then wiped 25 cycles with a white washcloth. For the testing of Formula A, 25 g of Formula A was sprayed on each sample of carpet, and then the carpet was wiped with a white washcloth for 25 cycles. All carpet samples were then allowed to dry followed by vacuuming. This procedure was repeated four times.

Twenty-one panelists were selected and the control carpet samples and the carpet samples cleaned with Formula A were shown to them. The panelists were instructed that all samples (both the controls and the carpet cleaned with Formula A) had been treated with a carpet cleaner. They were then asked if treatment with the "cleaners" (i.e. water or Formula A) had damaged the carpets.

Table I illustrates the panel results. Out of 21 people paneled, the number of people who gave a response 'yes' to the question on whether the carpet appeared damaged. As employed throughout the examples, when the data is analyzed using the "Chi Square method" (as described in *Statistical Analysis* (2nd Edition) by Samuel B. Richmond, The Ronald Press Co., New York, 1964, p. 290–303) at a 95% confidence level, 15 panelists for each product tested per carpet would have had to give a 'yes' response for there to be any significance between the products tested. As shown by the data, at most only one panelist saw a difference with the carpet cleaned by Formula A.

The carpet samples cleaned with Formula A were also compared to virgin pieces of the same carpet using a Minolta CHROMOMETER TM Model C-R 110 reflectometer. Table II illustrates the reflectometer readings taken. ΔE represents the difference in reflected light between the carpets cleaned with product, and a virgin piece of the same carpet. This value has been corrected for any carpet fiber change by rubbing. A ΔE value less than 2.0 is usually undetected by the human eye.

TABLE I

Panel Results
25 Panelists Instructed: These carpets have been treated with a carpet cleaner. After treatment with these cleaners, are these carpets damaged? Yes or No.
# of Yes Responses out of 21 Panelists

| Carpet | Water Washed | Formula A |
|---|---|---|
| DuPont: | | |
| STAINMASTER CHAMPLIN Almond | 0 | 0 |
| STAINMASTER CHAMPLIN Ocean Blue | 1 | 2 |
| STAINMASTER CHAMPLIN Embers | 2 | 2 |
| STAINMASTER CHAMPLIN Golf Green | 0 | 0 |
| Philadelphia: | | |
| MAINSTREET Cotton Seed | 0 | 0 |
| MAINSTREET Imperial Red | 0 | 1 |
| MAINSTREET Smoked Blue | 0 | 1 |
| MAINSTREET Laguna Green | 0 | 1 |
| Etoil: | | |
| Wool Geranium | 0 | 0 |
| Wool Elegan | 0 | 2 |
| Lees: | | |
| Polyester Parchment | 0 | 0 |
| Polyester Bordeaux | 0 | 0 |
| Polyester Sapphire | 0 | 0 |

TABLE II

Reflectometer Results

| Carpet | Δ E Formula A |
|---|---|
| DuPont: | |
| STAINMASTER CHAMPLIN Almond | −2.35 |
| STAINMASTER CHAMPLIN Ocean Blue | 0.42 |
| STAINMASTER CHAMPLIN Embers | −3.61 |
| STAINMASTER CHAMPLIN Golf Green | −2.89 |
| Philadelphia: | |
| MAINSTREET Cotton Seed | −0.25 |
| MAINSTREET Imperial Red | −1.89 |
| MAINSTREET Smoked Blue | −3.95 |
| MAINSTREET Laguna Green | −3.16 |
| Etoil: | |
| Wool Geranium | 4.15 |
| Wool Elegan | 3.29 |
| Lees: | |
| Polyester Parchment | 0.13 |
| Polyester Bordeaux | 0.10 |
| Polyester Sapphire* | — |

*Reflectometer readings could not be done on this color because it is out of range (too dark).

Example 2

The removal of feline malodor with Formula A was tested as follows. A 5"×5" piece of DuPont STAINMASTER TM Champlin Almond Carpet was stained with 2 g of cat urine (obtained from Buckshire Labs, Perkosie, Pa.). The urine was allowed to stand on carpet sample for one (1) hour. Excess urine was blotted up with a dry paper towel. The carpet was then cleaned with 25 g of Formula A by spraying the composition on the carpet and then allowing it to sit for 10 minutes. The carpet was then blotted with white paper towel until the visual stain was gone. The carpet was then allowed to dry. The cleaned carpet was then evaluated by a panel of twenty-five (25) people who were asked the question, "Does this carpet smell clean and fresh smelling?" Twenty-four (24) panelists responded yes and one (1) panelist responded no, thereby providing in excess of a 95% confidence level (using the Chi-Square method).

Example 3

DuPont STAINMASTER Nylon (Color: Champlin Embers), Etoil Wool (Color: Geranium), Lees Polyester (Color: Bordeaux) were tested to determine whether treatment of the carpets with Formula A left the carpet soft (desirable) or sticky (undesirable).

Each of the carpets were cut into 6"×6" pieces. Each carpet piece was treated with 25.0 grams of Formula A and rubbed into the carpet with a wet, white paper towel for approximately 50 strokes. The carpets were then allowed to dry. Twenty-five (25) people were paneled, asking them the following question: "Is the carpet soft, not stiff or sticky?"

Table III illustrates the panel results. The table shows out of twenty (20) people paneled, how many gave a response of 'yes' to the question asked.

TABLE III

Panelist
Response to Question "Is the carpet soft, not sticky?"

| Carpet | # of yes Responses | # of No Responses |
|---|---|---|
| Nylon | 24 | 1 |
| Wool | 25 | 0 |
| Polyester | 25 | 0 |

Example 4

Resoiling was tested on carpeting that was cleaned with Formula A. Carpets tested were DuPont STAINMASTER CHAMPLIN: Almond and Philadelphia MAINSTREET: Cotton Seed. The test procedure involved a 1'×3' section of carpet (for each carpet tested). One portion of the section was used as a control. For the test, 50 grams of Formula A was sprayed on the other portion of the carpet. The product was then wiped into the carpet using clean, white absorbent cloth in the designated section, then allowed to dry. The carpet piece was then placed in hallway, rotating 180° every week, until the carpet was visually dirty. The carpet piece was then removed from hallway and vacuumed. Reflectometer readings were taken of the sections, comparing the portion cleaned with Formula A to the virgin carpet to see if Formula A resoiled more quickly than the untreated Control portion. Both types of carpets were then visually paneled by thirty (30) people using the following scale:

| Scale |
|---|
| 1 = very soiled |
| 5 = slightly soiled |

Visual Panel Results are shown in Table IV below.

TABLE IV

| | Visual Panel Scale: 1 = very soiled 5 = slightly soiled | |
|---|---|---|
| AVERAGE RATING | DuPONT | PHILADELPHIA |
| Formula A | 4.04 | 2.80 |
| Control | 3.58 | 2.00 |

The results indicate that Formula A did not contribute to resoiling.

Reflectometer readings were also taken of the carpet sections, with results summarized in Table V below.

TABLE V

| | Reflectometer Readings Δ E Values | |
|---|---|---|
| | DuPont STAINMASTER | Philadelphia MAINSTREET |
| Control | 6.06 | 7.40 |
| Formula A | 3.71 | 10.82 |

*The greater the Δ E, the dirtier the carpet section.
**Δ E values less than 2.0 are usually undetected by the human eye.

Example 5

For this test, a 7'×8' room was utilized.

Philadelphia MAINSTREET carpet (Color: Cottonseed) and carpet padding were cut to 12"×24" pieces. The padding was then placed on a 12"×24" concrete block with the carpet placed on top of the padding inside the room. Twenty-five (25) g of cat urine (Buckshire Labs) was then placed on the center of the carpet and allowed to sit for two minutes. Excess urine was then blotted up with a paper towel. Approximately 70 g of Formula A was sprayed on the stain and then left for 10 minutes. Excess product was then blotted with a dry paper towel. The stain was then cleaned with a wet paper towel and the carpet was allowed to dry overnight. The room door was closed and there was no other means of ventilation.

Twenty (20) panelists were asked to enter the room the next day, close the door and sniff. They were then asked the following question: "Do you smell a yucky or awful odor?" They were asked to reply 'yes' or 'no'. Of the 20 panelists, 19 said 'no' and 1 answered 'yes', thus yielding a 95% confidence level using the Chi square method of data analysis that the room did not smell 'yucky'.

Example 6

Example 5 was repeating with dog urine rather than cat urine. The results were identical, with '1' person answering 'yes' and '19' answering 'no'. Data analysis showed a 95% confidence level using the Chi square method of data analysis.

The invention has been described above with particular reference to preferred embodiments. A skilled practitioner familiar with the above-detailed description can make many modifications and substitutions without departing from the scope and spirit of the invention.

That which is claimed is:

1. An aqueous cleaning composition consisting essentially of:

(a) from about 4.23% to about 4.28% by weight of a sodium or potassium salt of a diethylenetriaminepentaacetic acid, an ethylenediaminetetraacetic acid, a N-hydroxyethylethylenediaminetriacetic acid, or mixtures thereof;

(b) from about 1.95% to about 2.05% by weight of a diethylenetriaminepentaacetic acid, an ethylenediaminetetraacetic acid, a N-hydroxyethylethylenediaminetriacetic acid, or a mixture thereof;

(c) from about 0.82% to 0.98% of a sodium lauryl sulfate;

(d) from about 0.49% to 0.59% by weight of an acrylate copolymer of the formula $CF_3(CF_2)_nCH_2OCOC(CH_3)=CH_2$ wherein n is from 6 to 8;

(e) from about 0.22% to about 0.27% by weight of an octylphenoxypolyethoxy ethanol;

(f) from about 0.35% to about 0.5% by weight of fragrance; and (g) from about 0.00003% to about 0.05% by weight of a preservative selected from the group consisting of 5-chloro-2-methyl-4-isothiazolin-3-one, 2-methyl-4-isothiazolin-3-one, and mixture thereof;

wherein said weight percentages are based on the total weight of the aqueous composition.

2. A composition according to claim 1 wherein said (a) is sodium ethylenediaminetetraacetate.

3. A composition according to claim 2 wherein (a) is present in an amount of approximately 4.25%.

4. A composition according to claim 1 wherein (b) is ethylenediaminetetraacetic acid.

5. A composition according to claim 4 wherein (b) is present in an amount of approximately 2%.

6. A composition according to claim 1 wherein (c) is present in an amount of approximately 0.9%.

7. A composition according to claim 1 wherein (d) is present in an amount of approximately 3%.

8. A composition according to claim 1 wherein (e) is present in an amount of approximately 0.25%.

9. A composition according to claim 1 wherein (g) is present in an amount of about 0.001% to 0.002% by weight and is a mixture of 5-chloro-2-methyl-4-isothiazolin-3-one and 2-methyl-4-isothiazolin-3-one.

10. An aqueous cleaning composition consisting essentially of:

(a) from about 4.23% to about 4.28% by weight of a sodium or potassium salt of a diethylenetriaminepentaacetic acid, an ethylenediaminetetraacetic acid, a N-hydroxyethylethylenediaminetriacetic acid, or mixtures thereof;

(b) from about 1.95% to about 2.05% by weight of a diethylenetriaminepentaacetic acid, an ethylenediaminetetraacetic acid, a N-hydroxyethylethylenediaminetriacetic acid, or a mixture thereof;

(c) from about 0.82% to 0.98% of a sodium lauryl sulfate;

(d) from about 2.75% to 3.25% by weight of a water-based dispersion consisting essentially of from about 18 to 19 weight % an acrylate copolymer of the formula $CF_3(CF_2)_nCH_2OCOC(CH_3)=CH_2$ wherein n is from 6 to 8; about 1 weight % of a nonylphenoxypolyethoxyethanol; about 1 weight % sodium lauryl sulfate; about 1 weight % zinc oxide complex; and about from 76 to 77 weight % water wherein said weight % of the water dispersion components are based on the total weight of the acrylate water dispersion;

(e) from about 0.22% to about 0.27% by weight of an oxctylphenoxy polyethoxy ethanol;

(f) from about 0.35% to about 0.5% by weight of fragrance; and (g) from about 0.00003% to about 0.05% by weight of a preservative 1,2-benzoisothiazole-3(2H)-one, wherein said weight percentages are based on the total weight of the aqueous cleaning composition.

11. An aqueous composition according to claim 10 wherein:

(a) is present in an amount of about 4.25 weight %;
(b) is present in an amount of about 2 weight %;
(c) is present in an amount of about 0.9 weight %;
(d) is present in an amount of about 3 weight %;
(e) is present in an amount of about 0.25 weight %;
(f) is present in an amount of about 0.4 weight %; and is present in an amount of about 0.1 weight %.

12. An aqueous composition according to claim 11 wherein:

(a) is sodium ethylenediaminetetraacetate;
(b) is ethylenediaminetetraacetic acid; and
(g) is a mixture of 5-chloro-2-methyl-4-isothiazolin-3-one and 2-methyl-4-isothiazolin-3-one.

13. A method of cleaning a rug, carpet or textile by using as a cleaning agent an aqueous cleaning composition consisting essentially of:

(a) from about 4.23% to about 4.28% by weight of a sodium or potassium salt of a diethylenetriaminepentaacetic acid, an ethylenediaminetetraacetic acid, a N-hydroxyethylethylenediaminetriacetic acid, or mixtures thereof;
(b) from about 1.95% to about 2.05% by weight of a diethylenetriaminepentaacetic acid, an ethylenediaminetetraacetic acid, a N-hydroxyethylethylenediaminetriacetic acid, or a mixture thereof;
(c) from about 0.82% to 0.98% of a sodium lauryl sulfate;
(d) from about 0.49% to 0.59% by weight of an acrylate copolymer of the formula $CF_3(CF_2)_nCH_2OCOC(CH_3)=CH_2$ wherein n is from 6 to 8;
(e) from about 0.22% to about 0.27% by weight of an octylphenoxypolyethoxy ethanol;
(f) from about 0.35% to about 0.5% by weight of fragrance; and
(g) from about 0.00003% to about 0.05% by weight of a preservative 1,2-benzoisothiazole-3(2H)-ones;

wherein said weight percentages are based on the total active ingredient weight of the aqueous composition.

14. A method according to claim 12 wherein said composition reduces malodor of urine stains.

15. A method according to claim 13 wherein:

(a) is present in an amount of about 4.25 weight %;
(b) is present in an amount of about 2 weight %;
(c) is present in an amount of about 0.9 weight %;
(d) is present in an amount of about 0.54 weight %;
(e) is present in an amount of about 0.25 weight %;
(f) is present in an amount of about 0.4 weight %; and
(g) is present in an amount of about 0.1 weight %.

* * * * *

UNITED STATES PATENT AND TRADEMARK OFFICE

CERTIFICATE OF CORRECTION

PATENT NO. : 5,395,555

DATED : March 7, 1995

INVENTOR(S) : Andrew F. Colurciello et al.

It is certified that error appears in the above-indentified patent and that said Letters Patent is hereby corrected as shown below:

On the Cover Page, [75] Inventors: should read: "Andrew F. Colurciello, of Newburgh, N.Y.; Jeanne M. Weller, of Glen Rock, N.J."

In the Claims, column 9, line 11, before the words "is present" insert --(g)--.

Signed and Sealed this

Sixth Day of June, 1995

Bruce Lehman

*Attest:*

BRUCE LEHMAN

*Attesting Officer*

*Commissioner of Patents and Trademarks*